US006808080B2

(12) United States Patent
Spiers et al.

(10) Patent No.: US 6,808,080 B2
(45) Date of Patent: Oct. 26, 2004

(54) CONTAINER LATCHING METHOD AND APPARATUS

(75) Inventors: Kent Spiers, Caledonia, MS (US); Barry Sandlin, Winfield, AL (US)

(73) Assignee: Delaware Capital Formation, Inc., Wilmington, DE (US)

( * ) Notice: Subject to any disclaimer, the term of this patent is extended or adjusted under 35 U.S.C. 154(b) by 151 days.

(21) Appl. No.: 10/092,492

(22) Filed: Mar. 8, 2002

(65) Prior Publication Data

US 2003/0168466 A1 Sep. 11, 2003

(51) Int. Cl.[7] ..... B65D 43/26

(52) U.S. Cl. ..... 220/263; 220/324; 220/835; 220/908; 292/95

(58) Field of Search ..... 49/279; 292/95, 292/130, 230, DIG. 4; 220/908, 262–263, 324, 835, 315

(56) References Cited

U.S. PATENT DOCUMENTS

| | | | | |
|---|---|---|---|---|
| 1,034,515 A | | 8/1912 | Sack | |
| 1,874,833 A | * | 8/1932 | Taylor | 220/263 |
| 3,315,828 A | | 4/1967 | Dubo | |
| 4,155,584 A | | 5/1979 | Pracchia | |
| 4,165,897 A | | 8/1979 | Schmidt | |
| 4,538,512 A | * | 9/1985 | Blough | 100/131 |
| 5,094,358 A | | 3/1992 | Serio, Sr. | |
| 5,094,487 A | | 3/1992 | Drewry | |
| 5,201,434 A | * | 4/1993 | DeVivo et al. | 220/315 |
| 5,203,664 A | * | 4/1993 | Jensen | 414/407 |
| 5,224,744 A | * | 7/1993 | Michelutti | 292/234 |
| 5,330,307 A | * | 7/1994 | Spiers et al. | 414/406 |
| 5,415,314 A | | 5/1995 | McCollum | |
| 5,474,341 A | * | 12/1995 | Putman et al. | 292/230 |
| 5,599,050 A | * | 2/1997 | Tinsley | 292/230 |
| 5,683,126 A | * | 11/1997 | De Vivo et al. | 292/230 |
| 5,738,395 A | | 4/1998 | Probst | |
| 5,772,061 A | * | 6/1998 | Lowe | 220/254.3 |
| 5,772,264 A | | 6/1998 | Bettenhausen | |
| 6,290,093 B1 | * | 9/2001 | Obriot et al. | 220/835 |

* cited by examiner

*Primary Examiner*—Robin A. Hylton
(74) *Attorney, Agent, or Firm*—Liniak, Berenato & White, LLC

(57) ABSTRACT

An apparatus designed to automatically latch and unlatch the lid of a container. The apparatus includes a weight pivotally mounted on the side of the container for movement between first and second positions. The weight is positively connected to a latch by a connecting rod, and as the weight pivots between first and second positions, it moves the latch between latching and unlatching positions. Tipping the container causes the weight to shift thus the container is unlatched only when it is being dumped. A method for operating the latch is also disclosed.

27 Claims, 6 Drawing Sheets

CONTAINER LATCHING METHOD AND APPARATUS

FIELD OF THE INVENTION

The present invention is directed to an automatic container latch and method of operating same, and more specifically, toward a gravity-operated container latch that shifts from a latched to an unlatched position when a container is pivoted from a rest orientation to a dumping orientation.

BACKGROUND OF THE INVENTION

Facilities that produce substantial amounts of waste often dispose it in large trash receptacles that are emptied periodically by a trash truck. Generally, the receptacles are formed from steel or a similar material and are too heavy to lift manually, especially when full. A trash truck having a special lift is thus normally used to raise and empty these containers. To lift a container, the truck parks so that fingers on a lift arm on the truck can be inserted into special openings on the trash receptacle. The lift arm is then raised in an arc toward an opening in the top or side of the truck and tipped toward the opening until all trash in the receptacle falls out. Such trash receptacles often have lids hingedly connected to the their main bodies, and the lids pivot open as the receptacle is tipped. After the receptacle has been emptied, the lift arm returns it to an upright position and lowers it to the ground.

Certain trash receptacles are used with trash compactors that have a ram for forcing trash into the receptacle to reduce its volume and increase its density. These rams often push trash into a receptacle from one side, and it is thus necessary to hold the receptacle lid securely in place or the compacted trash will be forced upward by the ram and rise up and out of the receptacle. Even small gaps between the receptacle and its lid may allow unacceptable amounts of trash to escape, especially when the trash has a significant liquid component. These receptacles therefore generally include a latching mechanism that holds the receptacle lid securely closed and allows little or no gap between the container body and the lid even when trash therein is being compressed.

When such containers are to be emptied by a trash truck, a truck driver or another person must approach the trash container, release the latch, dump the receptacle into the truck and then return to re-latch the container. This latching and unlatching significantly reduces the advantages of using an automatic trash collection truck.

Automatic latch releases are known from the prior art which may be opened and closed by a radio transmitter, for example. However, such electronic solutions can be expensive to implement and require that the operator of a trash truck carry one or more transmitters for opening any container on his route. Also know from the prior art are containers with latches that are actuated by gravity when the container tips from an upright to a dumping position. Most of these latches, however, are designed either to keep a container lid closed under high wind conditions or to prevent unauthorized persons from gaining access to the trash container and are not suited for use with a compactor receptacle that is subjected to significant internal pressures during use. For example, U.S. Pat. No. 5,094,487 shows a trash receptacle comprising a body and a lid that has a housing mounted on one of the body sidewalls. A hook depends from the lid and extends into the housing when the lid is closed and the container is resting on its bottom. A freely pivotable rod inside the housing includes a projection that engages the hook when the container is horizontal and that pivots away from the hook to release it when the container is tipped. However, the clearances required by this arrangement do not allow the lid to be held completely shut, and thus the lid would open under the application of pressure from within and force trash out of the top thereof. U.S. Pat. No. 4,155,584 shows an automatic lock for a container that includes a pivotable weight which swings though an arc and impacts against a latch to release the latch when the container is inverted. This complex arrangement requires that the weight impact against a release with sufficient force to unhook the latch. If the lid of a receptacle is forced upwardly by pressure from compacted trash inside the container, the unlatching device might not function properly. Furthermore, the swinging arm impacting against a release is likely to lead to wear and may require the device to be replaced or repaired with some frequency.

There is thus a need for a container latch that automatically unlatches when the container is pivoted from a resting orientation to a dumping orientation and which re-latches when the container is returned to its resting orientation, which latch functions even when the contents of the container are under pressure and which holds the lid of the container securely closed with little or no gap between the lid and the container.

SUMMARY OF THE INVENTION

These problems are overcome by the subject invention which comprises an automatic latching device for a container such as a trash receptacle. The subject invention is particularly useful for securing the lids of trash receptacles, especially trash receptacles that are used in conjunction with a trash compactor that forces trash into the container under pressure; however the invention could be practiced with other types of dumpable receptacles without departing from the scope of this invention. Thus, while the container described herein is generally referred to a trash receptacle, the use of invention is in no way limited to such containers.

In the preferred embodiment, the invention is a container having a pivotable lid with a projection near its free end. This projection is engaged by a hook pivotally mounted on the sidewall of the container body. When the hook engages the projection, the lid is held firmly against the top of the container body. Furthermore, because the hook is pivotally mounted, it can resist upward pressure on the lid such as may be exerted when the container receives trash under pressure from a compactor. Also attached to the container sidewall is a weight mounted for pivotal movement about an axis located near the edge of the weight which weight assumes a first position when the container is in an upright position and a second position when the container tips toward a dumping position. The weight is connected to the hook by a rigid rod, and when the weight pivots, it moves the rod and the hook to release the hook or reengage it with the projection. As described more fully hereinafter, the arrangement of the rod and the weight increases the effective force applied against the hook to provide for secure, positive latching.

Also according to the preferred embodiment, the weight is mounted in a bi-stable manner so that once it becomes unbalanced it shifts from the first position to the second position and does not remain in an intermediate position for a significant amount of time. This helps ensure that the latch is positively engaged or disengaged and not left in some intermediate position. In addition, two stops are provided to limit the pivotal movement of the weight. The relationship between the center of gravity of the weight and the weight's axis of rotation is selected so that once the center of gravity passes over the pivot axis, the weight falls a further distance and impacts against a stop. Thus when the container moves from a rest orientation to a dumping orientation, the weight shifts when the container is tipped at a first angle, and when the container is moved from a dumping orientation to a rest orientation, the weight shifts back when the container is tipped at a second angle. This allows the latch to be latched and unlatched at different points in the travel of the container from a rest orientation to a dumping orientation, depending on the direction that the container is being tipped. Preferably, the lid is kept latched until the container opening is nearly vertical or until the container is inverted to ensure no trash falls from the container before it is properly positioned. However, the lid cannot be re-latched until the lid falls back onto the container body under the force of gravity when the container is relatively horizontal.

It is therefore a principal object of the present invention to provide a dumpable container having an automatic latch release.

It is another object of the present invention to provide a gravity-operated latch for a lidded container.

It is a further object of the present invention to provide a gravity-operated latch for a dumpable container that includes a bi-stably mounted actuating weight.

It is still another object of the present invention to provide a gravity-operated latch for a dumpable container that includes a weight positively coupled to a fastener to positively shift the fastener between first and second positions as the weight moves.

It is still a further object of the present invention to provide a method of positively latching and unlatching a container using a gravity-operated actuator.

It is yet another object of the present invention to provide a method of latching a lid to a container body in a manner that holds the lid securely against the container body using a gravity-operated actuator.

In furtherance of these objects, a container is provided that comprises a body having an interior, an exterior, a sidewall and a top opening, and a lid having a first end hingedly connected to the body and a second end, the lid being shiftable between a closed position covering the top opening and an open position allowing access to the interior. The lid is secured by a fastener and the fastener is positively shifted between a securing and a releasing position by a gravity-operated actuator that includes a weight mounted on the body exterior for bi-stable movement between a first position and a second position with respect to the sidewall, and a rigid link connecting the weight to the fastener so that the fastener is shifted from the securing position to the releasing position when the weight shifts from the first position to the second position.

The invention further comprises a container adapted to be moved from a rest orientation to a dump orientation during a dumping operation including a body having an interior and a top opening into the interior and a lid having a first end hingedly connected to the body and shiftable between a closed position covering the top opening and an open position allowing access to the interior. The container assumes a first angular orientation with respect to the ground when it is in a rest orientation and a second angular orientation with, respect to the ground when it is in the dump orientation. The container also includes a fastener for holding the lid in the closed position and substantially preventing movement of the lid when pressure is applied against the lid from the interior and an actuator for positively shifting the fastener between a securing and a releasing position. The actuator includes a weight pivotably mounted on the body for movement to a first position with respect to the sidewall when the container has a first angular orientation with respect to the ground and to a second position with respect to the sidewall when the container has a second angular orientation with respect to the ground and a link rigidly connected between the weight and the fastener for transferring substantially all motion of the weight to the fastener.

The invention further comprises a method of latching and unlatching a container by changing the orientation of the container with respect to the ground including the steps of providing a container having a lid, providing a fastener shiftable between a first position for securing the lid to the container and a second position for releasing the lid, mounting a weight on the container to pivot bi-stably between first and second positions in response to changes in the orientation of the container, positively coupling the weight to the fastener, pivoting the container in a first direction until the weight shifts to the second position, dumping the contents of the container and pivoting the container from the second position to the first position until the weight shifts to the first position.

BRIEF DESCRIPTION OF THE DRAWINGS

These and other objects and advantages of the invention will be better understood from a reading and understanding of the following detailed description of the invention together with the following drawings.

DETAILED DESCRIPTION OF THE PREFERRED EMBODIMENT

Figure 1:
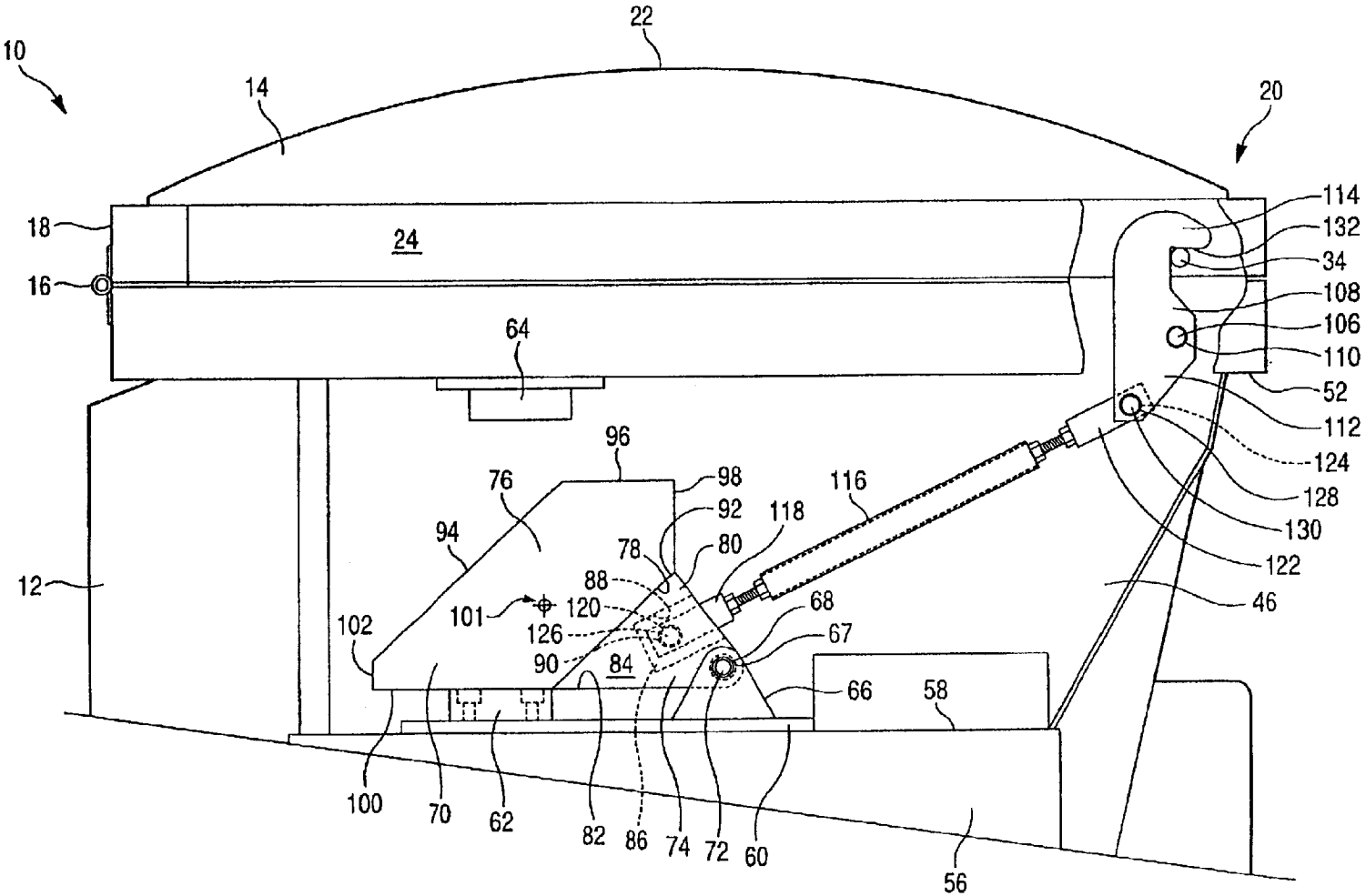
FIG. 1 is a side elevational view of a container with a gravity-operated latch in accordance with the present invention oriented in an upright, resting position.
Figure 2:
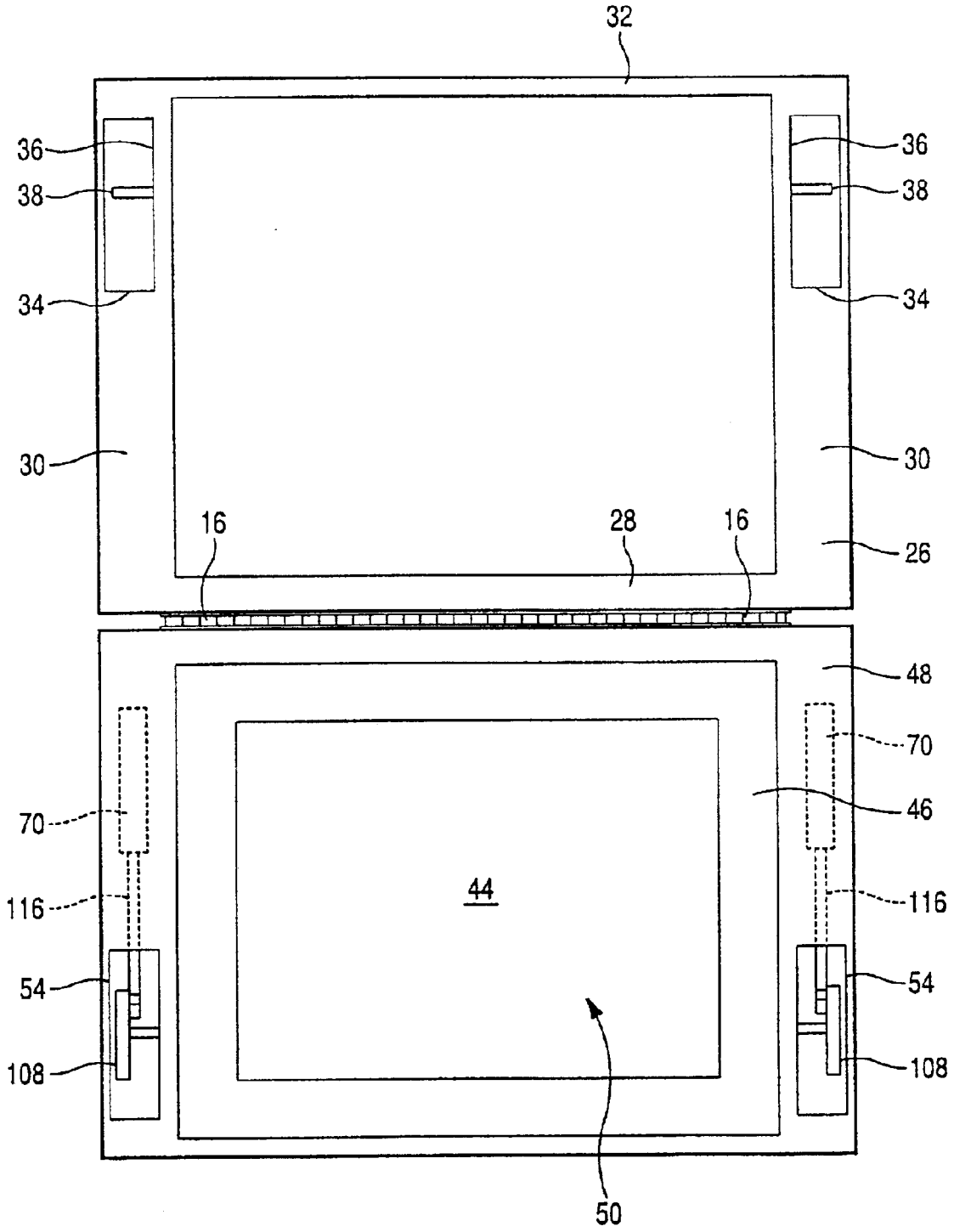
FIG. 2 is a top plan view of the container of FIG. 1 with the container lid in an open position.

Referring now to the drawings, wherein the showings are for the purpose of illustrating a preferred embodiment of the invention only, and not for the purpose of limiting same, FIGS. 1 and 2 show a container 10 according to the present invention which includes a body portion 12 and a lid 14 connected to the body by a hinge 16. Lid 14 includes a rear section 18 connected to body 12 by the hinge, a front section 20, a top wall 22, preferably outwardly curved to keep water from pooling thereon, a sidewall 24 depending from the top and a bottom wall 26. Bottom wall 26 includes a rear portion 28 adjacent hinge 16, first and second side portions 30 extending away from rear portion 28 and a front portion 32 connecting the side portions. Side portions 30 each include an opening 34 near front portion 32 having an interior wall 36 on which a pin 38 is mounted, which pins are engaged by fasteners to be described hereinafter for holding lid 14 securely against body portion 12.

Container body portion 12 includes a bottom 44, a sidewall 46 extending upwardly from the bottom, a top wall 48 extending outwardly from the top edge of sidewall 46 to define a top container opening 50, and a flange 52 depending from the outer edge of top wall 48. Top wall 48 includes first and second openings 54 near the front section 20 of the container which are aligned with openings 34 in lid 14 when the lid is closed and lid bottom wall 26 rests on body top wall 48. First and second sleeves 56 are attached at opposite portions of sidewall 24 for receiving the fingers of a trash truck lift arm and allowing the container to be lifted. The sleeves are parallel to one another, generally normal to the axis of hinge 16 and include open front portions which face the front of the container and top walls 58 that are generally horizontal when the container is in its normal rest orientation with bottom wall 44 facing the ground or other support surface and top opening 50 facing generally upwardly.

The container includes first and second latching mechanisms, one on each side of the container body. Only one latching mechanism is described and shown herein in detail, it being understood that the latching mechanism on the opposite side of the container is substantially identical to and functions in the same manner as the first mechanism.

A mounting plate 60 is attached to top wall 58 and a bottom stop 62 is mounted thereon. A top stop 64 is mounted between flange 52 and sidewall 24 directly above bottom stop 62. A triangular bracket 66 is mounted on mounting plate 60 forwardly of bottom stop 62, and includes a pair of spaced openings 67 that align with opening 68 in a weight 70 which openings receive a pin 72 to secure the weight to the bracket. Weight 70 comprises a triangular body portion 74 and a polygonal head portion 76 attached thereto or that alternately may be formed integrally therewith. Body portion 74 includes a first side wall 78 connected to the head portion of the weight, a second sidewall 80, a third side wall 82 and front and rear walls 84. Spaced openings 67 overlie front and rear walls 84 near the meeting point of second sidewall 80 and third sidewall 82 opposite first sidewall 78, and second sidewall 80 includes a slot 86 having opposed sidewalls 88 each having a journal opening 90 for supporting the opposite ends of a pin described hereafter. Head portion 76 includes a first wall 92 joined to first sidewall 78 of the body portion, a second wall 94 longer than and parallel to first wall 92, a third wall 96 extending from second wall 94 and a fourth wall 98 extending from first wall 92 and meeting third wall 96 at a 90 degree angle, a fifth wall 100 parallel to third wall 96 and coplanar with body portion third sidewall 82 and a sixth wall 102 connecting second wall 94 to fifth wall 100. As will be appreciated from the description of the operation of the subject invention, the shape of weight 70 and the location of its center of gravity 101 with respect to the pivot point formed at pin 72 helps control the movement of the weight and also provides for the multiplication of forces exerted on a container latching mechanism.

A pin 106 projects from sidewall 24 under top wall 48 and beneath lid pin 38. A latch 108 having a central opening 110 is mounted on pin 106 with pin 106 pivotally supporting the latch and extending though the latch central opening. The latch includes an attachment portion 112 on one side of central opening 110 and a hook portion 114 on the opposite side of the central opening. A connecting rod 116 includes a first end plate 118 having an opening 120 and a second end plate 122 having an opening 124 connects weight 70 to attachment portion 112 of latch 108. First end plate 118 of rod 116 extends into slot 86 in weight 70 and is attached thereto by a pin 126 having ends supported in journal openings 90 and passing through opening 120 in plate 118. Second end plate 122 is pivotally attached to an opening 128 in attachment portion 112 of latch 108 by a pin 130. Preferably the connecting rod is adjustable in length to that it can be adapted to containers of various sizes.

Hook portion 114 is dimensioned to engage pin 38 on lid 14 when the lid is closed. As will be appreciated from the foregoing description, when fifth wall 100 of weight 70 rests on bottom stop 62, hook portion 114 of latch 108 is held in engagement with pin 38. Weight 70 must be moved so that second wall 94 approaches top stop 64 in order to disengage hook 114 from pin 38 and allow the lid to open. Thus forces from inside the body (caused by compacted trash in the container, for example) pressing up against the lid do not move the latch, and the latch holds the lid securely closed even under significant internal pressures. Furthermore, when latch 108 is engaged with pin 38, the inner edge 132 of hook portion 114 is angled with respect to top wall 48 of the container, and thus as hook 114 passes over pin 38 into the latching position, the rotation of the latch exerts a downward force on pin 38 tending to hold lid 14 very securely shut.

Figure 8:
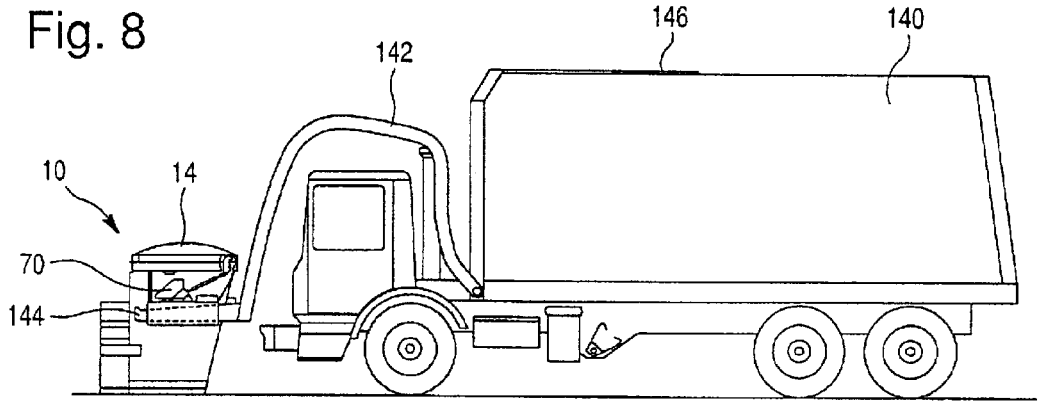
FIG. 8 is a side elevational view of a trash truck with a lift arm engaging the container of FIG. 1.
Figure 9:
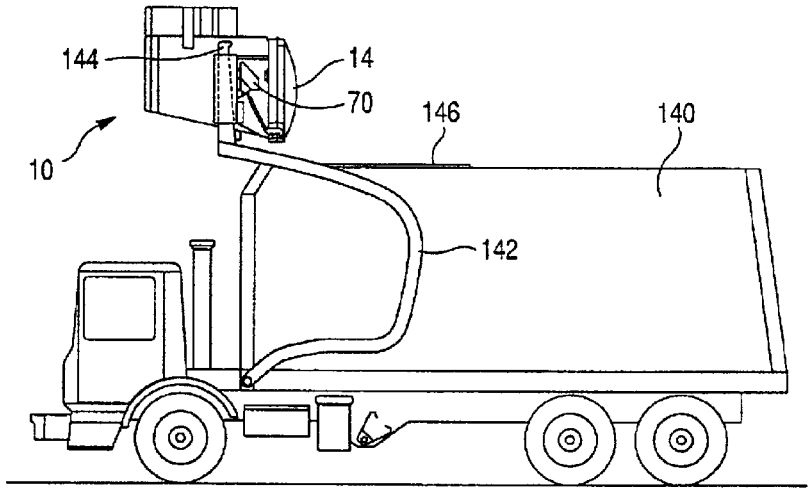
FIG. 9 is a side elevational view of the trash truck of FIG. 8 with the lift arm holding the subject container at a 90 degree angle.
Figure 10:
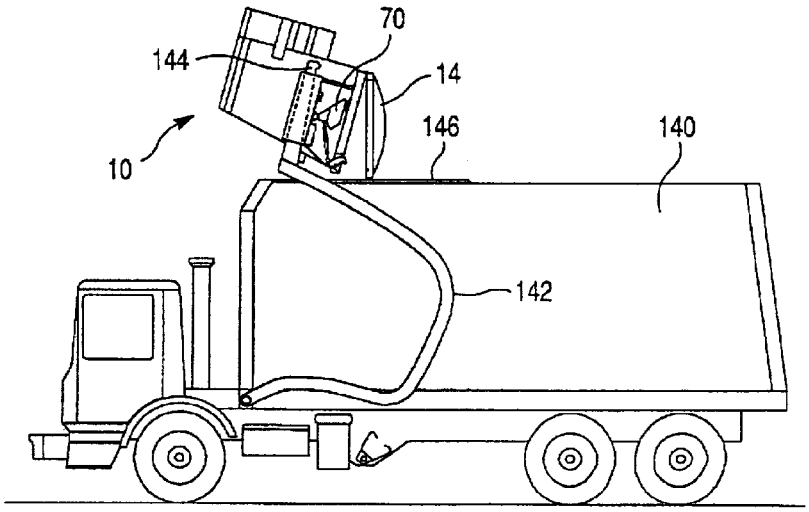
FIG. 10 is a side elevational view of the trash truck of FIG. 8 with the lift arm holding the container in a dumping position over an opening in the trash truck.

In operation, trash is loaded into container 10 through a side opening (not shown) by a compactor (not shown). When the container is ready to be emptied, it is disconnected from the compactor. A trash truck 140 having a lift arm 142 with fingers 144 approaches the container and inserts fingers 144 into sleeves 56 on either side of the container body, and the container is lifted through an upward arc toward an opening 146 in truck 140 into which trash will be discharged. FIGS. 8–10 show the movement of the container from a resting orientation on the ground to a dumping orientation over opening 146.

The orientation of the container will be described in terms of the angle between a container reference line extending normal to the plane of top opening 54 and a line normal to the ground. When the container is in a resting orientation with the sidewalls generally vertical and the top opening facing generally in an upward direction, the container is positioned at a 0 degree angle and weight 70 is supported by bottom stop 62 and holds latch 114 in engagement with pin 38 on lid 14.

Figure 3:
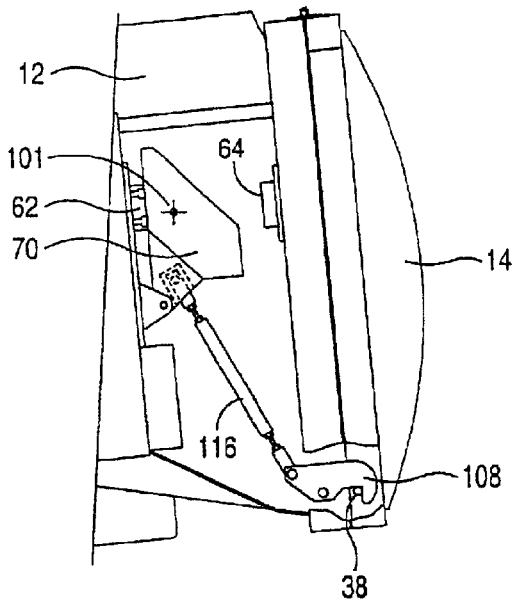
FIG. 3 is a side elevational view of the container of FIG. 1 showing the container tilted at about an 85 degree angle from the resting position.
Figure 4:
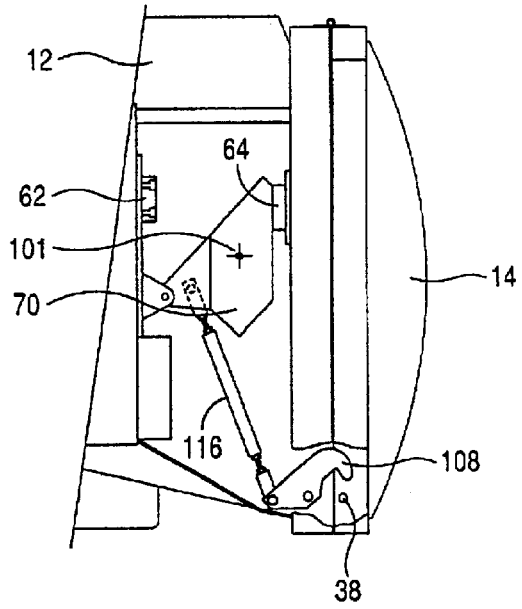
FIG. 4 is a side elevational view of the container of FIG. 1 showing the container tilted at about a 90 degree angle from the resting position.

FIG. 3 shows the container positioned at about an 85 degree angle. As can be seen from this figure, the center of gravity 101 of weight 70 still lies between a pivot point at pin 72 and bottom stop 62 and thus weight 70 continues to lie against the bottom stop. However, as shown in FIG. 4, when the container reaches the 90 degree position, the center of gravity of weight 70 moves to the other side of its pivot point, and weight 70 falls against top stop 64 moving rod 116 toward container top wall 48 and pivoting latch 114 to disengage hook 116 from pin 38.

Figure 5:
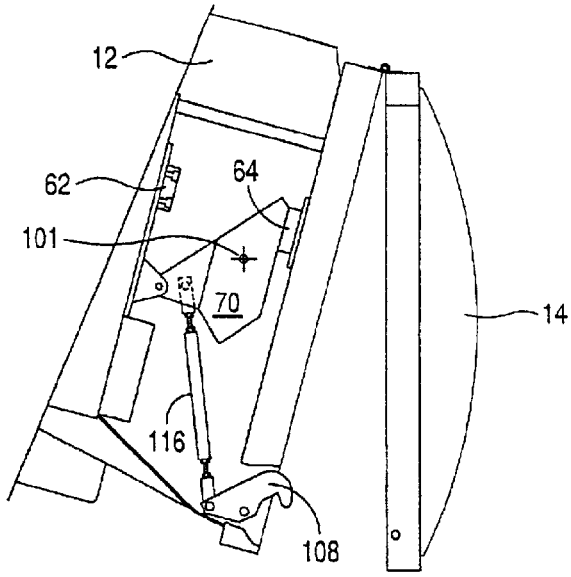
FIG. 5 is a side elevational view of the container of FIG. 1 showing the container tilted at about a 105 degree angle from the resting position.

FIG. 5 shows container 10 angled at 105 degrees with respect to the vertical, and in this position, lid 14 swings open under the force of gravity and under the weight of the trash inside the container as it falls toward the opening. Substantially all trash should fall out of container when it is tipped to a 150 degree angle shown in FIG. 6.

Figure 6:
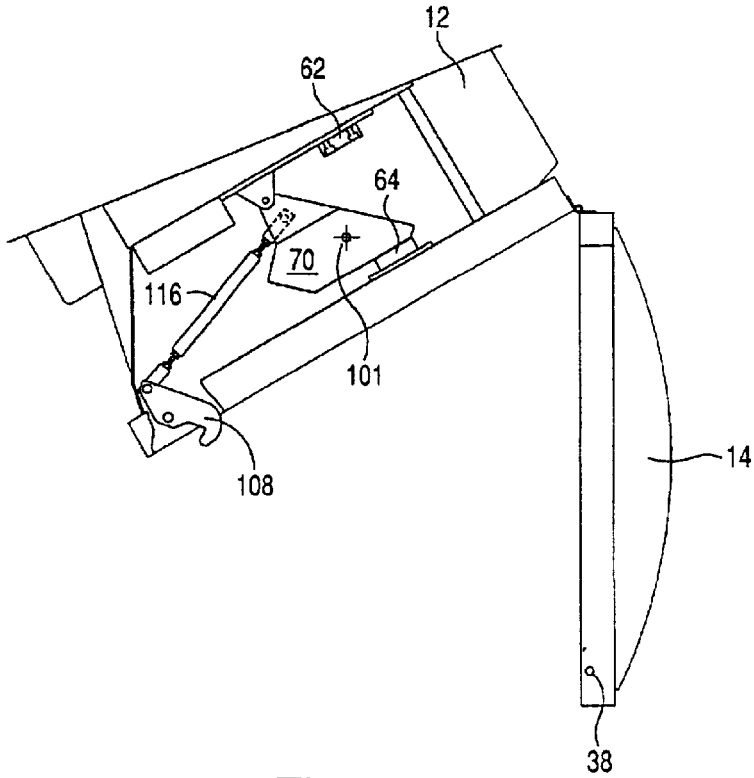
FIG. 6 is a side elevational view of the container of FIG. 1 showing the container tilted at about a 150 degree angle from the resting position.
Figure 7:
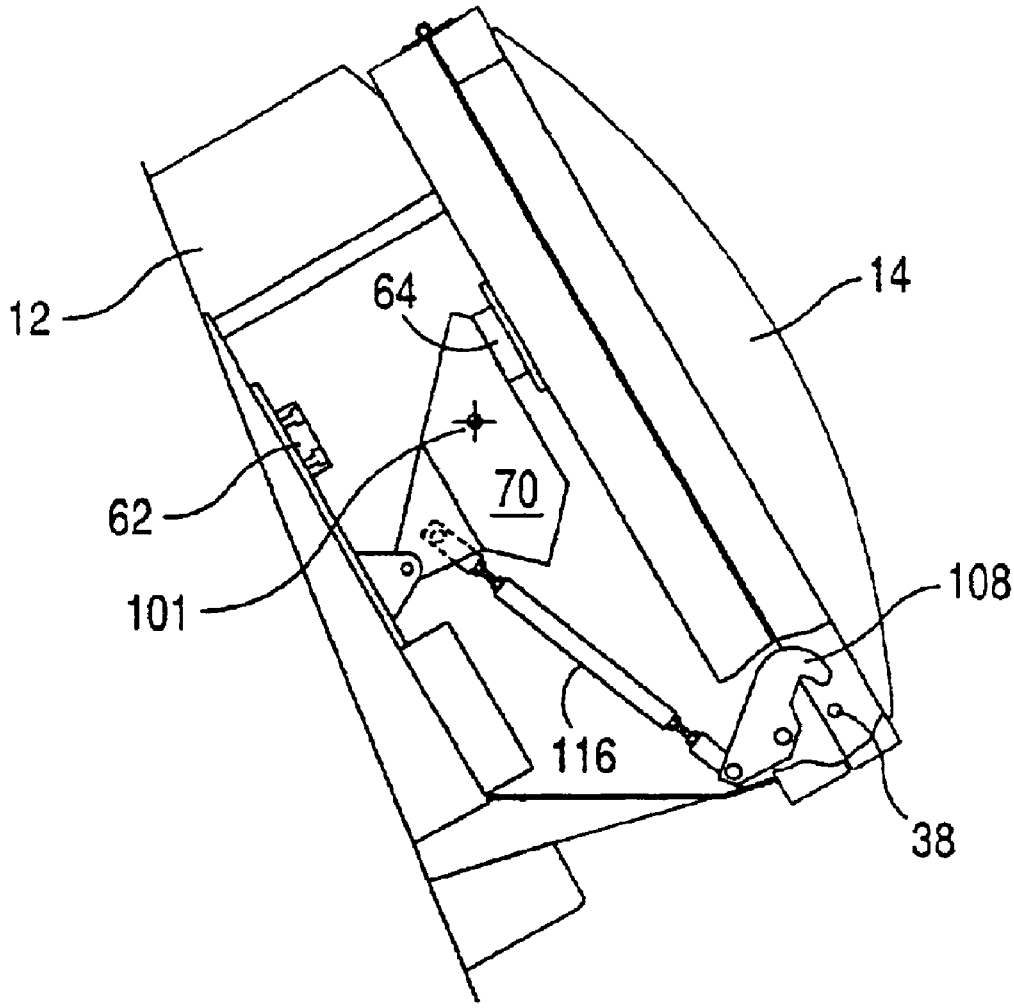
FIG. 7 is a side elevational view of the container of FIG. 1 showing the container tilted back to about a 60 degree angle after reaching the orientation shown in FIG. 6.

After reaching the dumping orientation shown in FIG. 6, the container is pivoted back toward the 0 degree resting orientation. When the container passes the 90 degree orientation, lid 14 comes into contact with top wall 48 of the container. However, as shown in FIG. 6, even when the container is at a 60 degree orientation shown in FIG. 7 and lid 14 rests on the top wall of the container, weight 70 remains resting on top stop 64 because center of gravity 101 remains on the top stop side of pivot point 72. Not until the container pivots past about a 45 degree orientation does weight 70 tip back against bottom stop 62 and pull hook 114 back into engagement with pin 38.

Advantageously, the shape and mounting of weight 70 described above causes it to shift from the bottom stop to the top stop at a first angular orientation and return from the top stop to the bottom stop at a second orientation. Thus, when dumping a full container, the lid can be held in a closed position until at least a 90 degree orientation to keep trash from prematurely spilling from the container. However, the latch does not reengage pin 38 until the container is more upright and lid 14 is resting solidly on top wall 48 of the container body under the force of gravity. This bi-stable mounting of weight 70 ensures that the latch is either completely engaged or disengaged, and the positive coupling between the weight and the latch, as well as the distance between the center of gravity of weight 70 and the pivot point 72 helps maximize the force applied to rod 116 when the weight begins to move.

The subject invention has been described in terms of a preferred embodiment, it being understood that obvious modifications and additions to the invention will become apparent to those skilled in the relevant arts upon a reading an understanding of this disclosure. It is intended that all such obvious modifications and additions be included in the subject invention to the extent that they are covered by the several claims appended hereto.

We claim:

1. A container comprising:

a body having an interior, an exterior, a sidewall and a top opening;

a lid having a first end hingedly connected to said body and a second end, said lid being shiftable between a closed position covering said top opening and an open position allowing access to the interior;

a fastener for holding said lid in said closed position; and a gravity-operated actuator for shifting said fastener between a securing and a releasing position;

wherein said gravity-operated actuator comprises:

a weight mounted on said body exterior for movement between a first position and a second position with respect to said sidewall; and a link having a first end pivotally attached to said fastener and said link having a second end pivotally attached to said weight;

wherein said fastener pivots between said securing position and said releasing position in response to said weight pivoting between said first position and said second position.

2. The container of claim 1 wherein said sidewall includes a fastener support, and said fastener comprises a latch pivotally mounted on said fastener support and having a first end comprising a hook and a second end.

3. The container of claim 2 wherein said link is attached to said fastener at said second end.

4. The container of claim 3 wherein said lid includes a projection engagable by said hook.

5. The container of claim 1 wherein said weight has a body portion and a head portion connected to said body portion and is pivotally mounted for rotation about a pivot point on said body portion spaced apart from said head portion.

6. The container of claim 5 wherein said container includes first and second stops on said side wall for limiting pivotal movement of said weight.

7. The container of claim 6 wherein said rigid link is pivotally connected to said weight body portion.

8. The container of claim 1 wherein said top opening lies in a plane and wherein said fastener remains in said securing position until the plane of said top opening is generally vertical.

9. The container of claim 1 wherein said weight is pivotally mounted on said sidewall and includes a pivot point.

10. The container of claim 9 wherein said weight includes a narrow end and a wide end and said pivot point is located on said narrow end.

11. The container of claim 10 wherein said rigid link is connected to said weight near said narrow end.

12. The container of claim 2 wherein said rigid link is pivotally connected to said latch second end.

13. A container adapted to be moved from a rest orientation to a dump orientation during a dumping operation comprising:

a body having an interior and a top opening into said interior;

a lid having a first end hingedly connected to said body and shiftable between a closed position covering said top opening and an open position allowing access to the interior;

said container having a first angular orientation with respect to the ground when said container is in a rest orientation and a second angular orientation with respect to the ground when said container is in said dump orientation;

a fastener pivotably mounted on said body at a first point for holding said lid in said closed position and substantially preventing movement of said lid when pressure is applied against said lid from said interior;

and an actuator for shifting said fastener between a securing and a releasing position;

wherein said actuator comprises:

a weight pivotably mounted on said body at a second point for movement from a first position with respect to said sidewall when said container has said first angular orientation with respect to the ground and to a second position with respect to said sidewall when said container has said second angular orientation with respect to the ground;

and a link connected between said weight and said fastener for transferring substantially all motion of said weight to said fastener.

14. The container of claim 13 wherein said weight shifts from said first position to said second position when said container assumes a third angular orientation with respect to the ground.

15. The container of claim 13 wherein said weight shifts from said second position to said first position when said container assumes a fourth angular orientation with respect to the ground.

16. The container of claim 15 wherein said fourth angular orientation is between said first angular orientation and said third angular orientation.

17. The container of claim 14 wherein said third angular orientation is greater than or equal to 90 degrees.

18. The container of claim 13 wherein said weight is bi-stably mounted on said container.

19. A method of latching and unlatching a container by changing the orientation of the container with respect to the ground comprising the steps of:

providing a container having a lid;

providing a fastener shiftable between a first position for securing said lid to said container and a second position for releasing said lid;

mounting a weight on said container exterior to pivot between first and second positions in response to changes in the orientation of said container;

coupling said weight to said fastener; and pivoting said container in a first direction until said weight shifts from said first position to said second position, said weight remaining in said first position until said container is pivoted at least 5 degrees in said first direction;

wherein the movement of said weight from said first position to said second position causes said link to apply a force to said fastener thereby releasing said lid.

20. A gravity-operated actuator for shifting a container lid latch between a latching position and an unlatching position, said actuator comprising:

a weight pivotably connected to an exterior of a container at a first point on said weight for movement between a first position and a second position with respect to the container; and a link pivotably connected to a second point on said weight, said link connecting said weight to the container lid latch;

wherein said fastener is shifted from said latching position to said unlatching position when said weight pivots at said first pivotal connection point with said container and said weight pivots at said second pivotal connection point with said link, said weight thereby pivoting from said first position to said second position.

21. The actuator of claim 20 wherein said weight has a body portion and a head portion connected to said body portion and is pivotally mounted for rotation about a pivot point on said body portion spaced apart from said head portion.

22. The container of claim 20 wherein said weight includes a narrow end and a wide end and said pivot point is located on said narrow end.

23. The container of claim 22 wherein said rigid link is connected to said weight near said narrow end.

24. A container comprising:

a body having an interior, an exterior, a sidewall and a top opening;

a lid having a first end hingedly connected to said body and a second end, said lid being shiftable between a closed position covering said top opening and an open position allowing access to the interior;

a fastener for holding said lid in said closed position; and a gravity-operated actuator for shifting said fastener between a securing position and a releasing position;

wherein said gravity-operated actuator comprises:

a weight mounted on said body exterior having a body portion and a head portion connected to said body portion and is pivotally mounted for rotation about a pivot point between a first position and a second position, said body portion being spaced apart from said head portion; and, a link connecting said weight to said fastener;

wherein said fastener is shifted from said securing position to said releasing position when said weight shifts from said first position to said second position.

25. A container comprising:

a body;

a lid connected to said body, said lid having an open and a closed position;

a fastener having a securing position for retaining said lid in said closed position and a releasing position for releasing said lid;

a weight attached to an exterior of said body; and a link connecting said weight to said fastener, wherein rotating said body from a first position to a second position causes said weight to pivot about a first point and apply a force to said link causing said fastener to pivot about a second point so that said fastener moves from said securing position to said releasing position thereby releasing said lid.

26. A container comprising:

a body;

a lid connected to said body, said lid having an open and a closed position;

a fastener connected to said body at a first point on said fastener, said fastener having a securing position for retaining said lid in said closed position and a releasing position for releasing said lid;

a weight attached to an exterior of said body; and a link connected to said fastener at a second point on said fastener, said link connecting said weight to said fastener, wherein rotating said body from a first horizontal position to a second angular position causes said weight to apply a force to said link causing said fastener to pivot about said first and second points so that said fastener moves from said securing position to said releasing position thereby releasing said lid.

27. A container comprising:

a body having a base;

a lid connected to said body, said lid having an open and closed position;

a fastener having a securing position for retaining said lid in said closed position and a releasing position for releasing said lid;

an actuator for shifting said fastener between said securing and said releasing positions;

wherein said actuator comprises:

a weight mounted on an exterior of said body; and, a link connecting said weight to said fastener;

said fastener remaining in said secured position until said base is rotated to an angle of about 90 degrees relative to a horizontal plane, further rotation of said base past 90 degrees causes said weight to shift from a first position to a second position thereby applying a force to said link causing said fastener to move from said securing position to said releasing position and allowing said lid to open.

* * * * *